United States Patent [19]

Roberts

[11] Patent Number: 4,705,262

[45] Date of Patent: Nov. 10, 1987

[54] FENCE INSTALLATION APPARATUS

[76] Inventor: Ronald R. Roberts, 24 Locke St., Box 528, Woodsboro, Tex. 78393

[21] Appl. No.: 916,906

[22] Filed: Oct. 7, 1986

[51] Int. Cl.[4] ..... B21F 27/00; E04H 17/02

[52] U.S. Cl. ..... 256/37; 256/36; 254/263

[58] Field of Search ..... 256/35, 36, 37; 254/263, 243

[56] References Cited

U.S. PATENT DOCUMENTS

| | | | |
|---|---|---|---|
| 327,814 | 10/1885 | Montgomery | 256/35 X |
| 860,318 | 7/1907 | Ostlund | 254/263 |
| 981,976 | 1/1911 | Burger . | |
| 1,574,671 | 2/1926 | Marek . | |
| 2,977,093 | 3/1961 | Vaughn . | |
| 4,264,055 | 4/1981 | Strange . | |
| 4,479,636 | 10/1984 | King | 256/35 |

FOREIGN PATENT DOCUMENTS

| | | | |
|---|---|---|---|
| 15117 | 7/1909 | Australia | 256/35 |

*Primary Examiner*—Andrew V. Kundrat

*Attorney, Agent, or Firm*—Henderson & Sturm

[57] ABSTRACT

A fence installing apparatus (10) for use in combination with a plurality of strands (100) of fencewire (101); wherein, the apparatus (10) comprises: a brace unit (11) having a ground engaging unit (13) on one end, and a tubular unit (14) on the other end, wherein the tubular unit (14) is provided with a retaining unit (15) and a locking unit (16); and, a stabilizing unit (12) comprising an elongated stabilizing rod member (26) that is dimensioned to be slidably received within said tubular unit (14); so that the retaining unit (15) can capture one strand (100') of fencewire (101); the tubular unit (14) can capture another strand (100''); and, the stabilizing unit (12) can capture yet another strand (100''') of fencewire (101).

6 Claims, 3 Drawing Figures

FIG. 1.
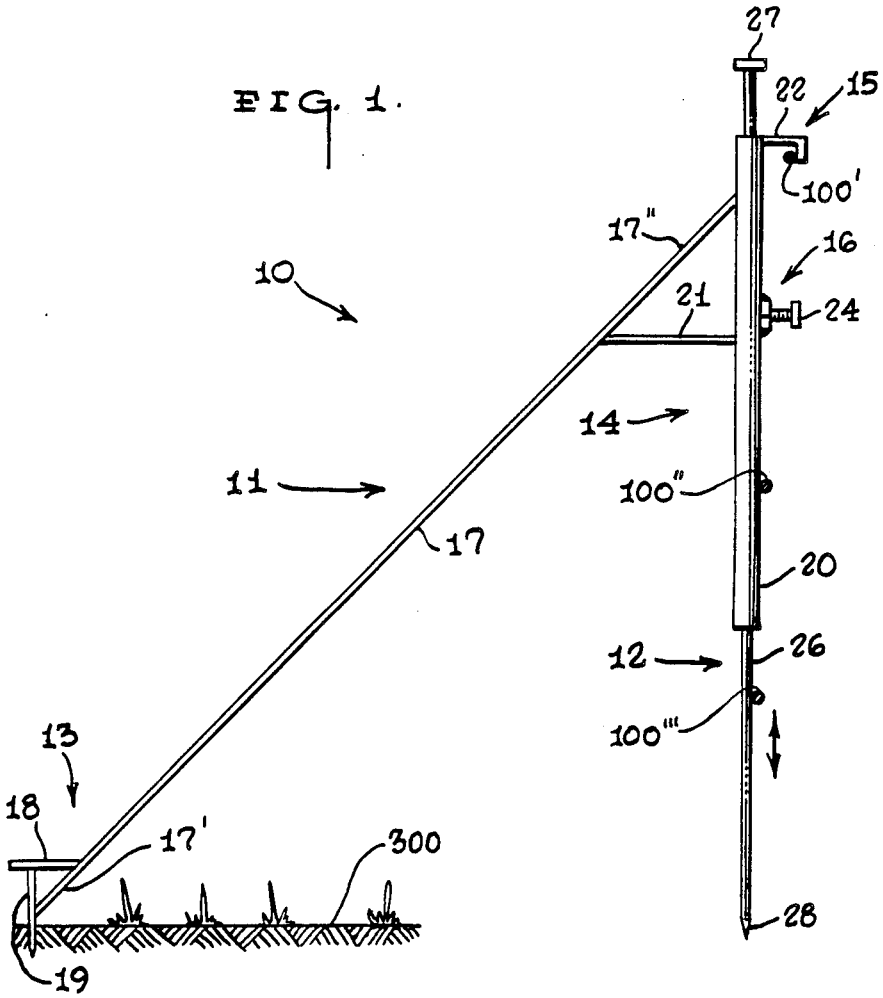
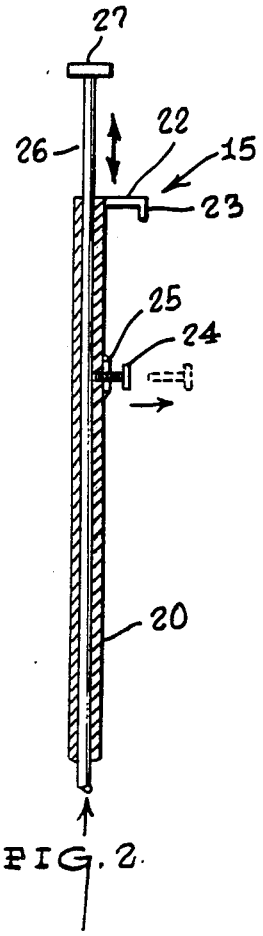
FIG. 2.
FIG. 3.
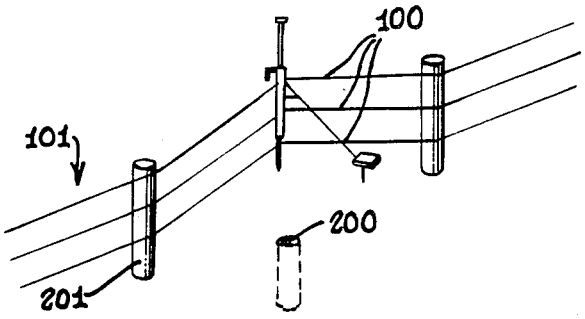

FENCE INSTALLATION APPARATUS

TECHNICAL FIELD

The present invention relates generally to wire stretching tools which can be used by one person.

BACKGROUND OF THE INVENTION

The prior art is replete with wire stretching tools which aid in the repair or fabrication of wire fencing.

Examples of these prior art constructions may be seen by reference to the following U.S. Pat. Nos.: 981,976; 1,574,671; 2,977,093; and, 4,264,055. While these prior art devices provide adequate assistance for wire fence workers they all suffer from shared as well as individual deficiencies.

Basically, the majority of prior art structures were developed to stretch wire fencing for purposes of tightening the wire prior to affixint it to a fence post. These structures each require the employment of an existing fence post to accomplish their individual functions. Therefore, none of the above mentioned structures could be utilized to stretch wires away from an existing fence in order to provide a clear working area to install or repair an individual fence post.

While the majority of prior art stretching devices can only be utilized in conjunction with an existing fence post, other prior art devices require two or more persons in order to stretch the wire away from the working area, in which a fence post is to be installed or repaired.

The aforementioned prior art devices are suitable for stretching wire away from a working area without depending upon an existing post. However, these devices require at least one person to secure these wires while another person or persons installs or repairs the fence post.

Obviously there has existed a longfelt need to develop a device which could function on its own to stretch fence wires without the need of an existing fence post, and without the assistance of an additional workman.

This device would also have to maintain these fence wires away from a working area without requiring continuous human assistance. This device would therefore allow fence work to be accomplished by a single individual.

SUMMARY OF THE INVENTION

The present invention was designed to provide a fence installer or repairman with assistance in regard to installing or repairing a fence. Specifically, the fence installation apparatus of this invention provides a workman with an unobstructed work area in that it will stretch or pull the existing fence wires away from the work site.

In addition, this invention will maintain these fence wires at a spaced location from the existing fence line until the release of the fence wire is desired.

Another object of this invention is to provide a device that is lightweight and yet sturdy and durable. In addition, this invention would be designed such that it is simple to operate, and requires a relatively small number of movable parts or components.

Yet another object of this invention is the provision of a fence installation apparatus that is easily movable, and which is also readily stabilized without a need for an existing fence component; and would not require continuous human intervention to maintain the fence wires at a given distance from the work site.

In general, the fence installing apparatus of this invention comprises a brace unit provided with a lower end having a ground engaging unit while the upper end is provided with a tubular unit; wherein a ground stabilizing unit is insertable through the tubular unit.

The tubular unit also consists of a retaining unit for engagement with fence wires and a locking unit to be used in conjunction with the insertable ground stabilizing unit.

BRIEF DESCRIPTION OF THE DRAWINGS

These and other objects, advantages, and novel features of the invention will become apparent from the detailed description of the best mode for carrying out the preferred embodiment fo the invention which follows; particularly when considered in conjunction with the accompanying drawings wherein:

FIG. 1 is a side elevation view of the fence installing apparatus of this invention;

FIG. 2 is an enlarged detailed cross-sectional view of a portion of the brace unit; and, FIG. 3 is a perspective view of the apparatus in its intended environment.

BEST MODE FOR CARRYING OUT THE INVENTION

As can be seen by reference to the drawings and in particular to FIG. 1, the fence installing apparatus that forms the basis of the present invention is designated generally by the reference numeral (10). The fence installing apparatus (10) comprises in general a brace unit (11) and a stabilizing unit (12); wherein, the brace unit further comprises a ground engaging unit (13) and a tubular unit (14); wherein, the tubular unit (14) is further provided with a retaining unit (15) and a locking unit (16). These units will now be described in seriatim fashion.

As can best be seen by reference to FIG. 1, the brace unit (11) comprises an elongated rigid brace member (17) having the ground engaging unit (13) disposed on its lower end (17'); and, having the tubular unit (14) disposed on its upper end (17"); wherein, the brace member (17) is oriented with respect to both the ground engaging unit (13) and the tubular unit (14) at an angle of approximately 45°.

The ground engaging unit (13) comprises a generally rectangular step plate member (18) provided with a downwardly depending spike element (19); and, as shown in FIG. 1, the brace member (17) is affixed to both the plate member (18) and the spike element (19), the provide strength and rigidity to that portion of the apparatus (10).

The tubular unit (14) comprises an elongated hollow cylindrical member (20), which is dimensioned to slidingly receive the stabilizing unit (12). The brace member (17) is operatively connected directly to the cylindrical member (20); and, as shown in FIG. 1 there is an auxiliary connection between the brace member (17) and the cylindrical member (20), which is formed by a generally horizontally disposed strut element (21) connected on opposite ends to the brace member (17) and the cylindrical member (20).

The retaining unit (15) is disposed proximate the top of the cylindrical member (20) and generally opposite the point of connection between the brace member (17) with the cylindrical member (20). As shown in FIGS. 1 and 2 the retaining unit (15) comprises a relatively short horizontally disposed arm member (22) secured on one end to the cylindrical member (20); and, provided on its free end with a downwardly depending retainer lip element (23).

As can best be seen by reference to FIGS. 1 and 2, the locking unit (16) comprises a threaded locking member (24), that is received in a complementary threaded aperture (25) provided in the cylindrical member (20); wherein, the locking member (24) can frictionally immobilize the stabilizing unit (12) within the cylindrical member (20) at a desired location.

The stabilizing unit (12) comprises an elongated stabilizing rod member (26) dimensioned to be slidably received within the cylindrical member (20); and having an enlarged head (27) on its upper end, and a tapered point (28) on its lower end.

As can best be appreciated by reference to FIG. 3, the fence installing apparatus (10) in one mode of use is employed to temporarily displace strands (100) of fencewire (101) from a given location, so that a posthold (200) can be dug to receive a new fence post (201).

In order to employ the apparatus (10) for this particular mode of operation the user would insert the cylindrical member (20) between the top (100') and middle (100") strand of a three strand fence. At this juncture the user would engage the top strand (100') in the retaining unit (15) and pull the wires in the desired direction. Then the user would step down on the step plate (18) to penetratingly engage the spike (19) with the ground (300).

At this point if the user had not already inserted the rod member (26) into the cylindrical member (20) to capture the lowermost strand (100''') as shown in FIG. 1; the user would then partially insert the rod (26) through the cylindrical member (20) to capture the lowermost strand (100''') as shown in FIG. 1; the user would then partially insert the rod (26) through the cylindrical member (20) and manually displace the lowermost strand (100''') to the position shown in FIGS. 1 and 3.

The last step in this mode of operation involves applying a downward force on the head (27) of the rod member (26) to drive the point (28) of the rod into engagement with the ground; and, then using the locking unit (16) to immobilize the rod (26) relative to the cylindrical member (20) at a desired height.

It should be appreciated at this juncture that, the fence installing apparatus (10) of this invention was developed to allow an individual workman to temporarily capture and displace fencewires in the fashion depicted in FIG. 1. The upper strand (100') is captured by the retaining unit (15). The middle strand (100") is captured behind the tubular unit (14); and, the lower strand (100''') is captured behind the stabilizing unit (12).

Having thereby described the subject matter of this invention it should be obvious that many substitutions, modifications, and variations of the invention are possible in light of the above teachings. It is therefore to be understood that the invention as taught and described herein, is only to be limited to the extent of the breadth and scope of the appended claims.

I claim:

1. A fence installing apparatus used in combination with a plurality of strands of fencewire; wherein the apparatus comprises:

a stabilizing unit comprising an elongated rod member; and, a brace unit comprising an elongated brace member having a ground engaging unit disposed on its lower end and a tubular unit disposed on its upper end; wherein, the brace member is angularly disposed with respect to said ground engaging unit and said tubular unit; wherein said tubular unit is dimensioned to slidably receive said elongated rod member; and, wherein said brace unit further comprises: a retaining unit provided on the upper portion of said tubular unit and comprising a relatively short arm member having a downwardly depending lip element; wherein, the lip member is configured to engage and restrain one of said plurality of strands of fencewire.

2. The fence installing apparatus of claim 1; wherein, said brace unit further comprises:

a locking unit operatively associated with said tubular unit and said elongated rod member, for temporarily immobilizing said rod member within said tubulra unit at a desired location.

3. The fence installing apparatus of claim 2; wherein, said ground engaging unit comprises:

a step plate member provided with a downwardly depending spike element.

4. The fence installing apparatus of claim 3; wherein, the stabilizing rod member is further provided with a tapered point on its lower end, and an enlarged head on its upper end.

5. The fence installing apparatus of claim 4; wherein, the angular disposition of the brace member with respect to both the tubular unit and the ground engaging unit is approximately 45°.

6. The fence installing apparatus of claim 5; wherein, the operative connection between the brace member and the tubular unit further comprises a generally horizontally disposed strut element, which extends between said brace member and said tubular unit.

* * * * *